US009493928B2

(12) United States Patent
Park et al.

(10) Patent No.: US 9,493,928 B2
(45) Date of Patent: Nov. 15, 2016

(54) METHOD AND APPARATUS FOR CONTROLLING ENGINE OF WHEEL LOADER

(71) Applicant: DOOSAN INFRACORE CO., LTD., Incheon (KR)

(72) Inventors: Kwang Seok Park, Gyeonggi-do (KR); Yun Jung Choi, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 14/414,814

(22) PCT Filed: Dec. 4, 2013

(86) PCT No.: PCT/KR2013/011150

§ 371 (c)(1),
(2) Date: Jan. 14, 2015

(87) PCT Pub. No.: WO2014/098391

PCT Pub. Date: Jun. 26, 2014

(65) Prior Publication Data

US 2015/0159347 A1 Jun. 11, 2015

(30) Foreign Application Priority Data

Dec. 18, 2012 (KR) ..... 10-2012-0148197

(51) Int. Cl.
*E02F 9/20* (2006.01)
*F02D 41/02* (2006.01)
(Continued)

(52) U.S. Cl.
CPC ..... *E02F 9/2246* (2013.01); *E02F 9/20* (2013.01); *E02F 9/2066* (2013.01); *F02D 29/04* (2013.01); *F02D 41/021* (2013.01); *F02D 2200/501* (2013.01)

(58) Field of Classification Search
CPC ..... E02F 9/20; F02D 29/04
See application file for complete search history.

(56) References Cited

U.S. PATENT DOCUMENTS

2002/0148144 A1* 10/2002 Tokunaga ..... B60K 6/442 37/348
2010/0161186 A1 6/2010 Quinn et al.
(Continued)

FOREIGN PATENT DOCUMENTS

EP 0522171 A1 1/1993
JP 2011127473 A 6/2011
(Continued)

OTHER PUBLICATIONS

International Search Report with English translation dated Mar. 18, 2014 for corresponding International Application No. PCT/KR2013/011150, filed Dec. 4, 2013.
(Continued)

*Primary Examiner* — Fadey Jabr
*Assistant Examiner* — Thomas Ingram
(74) *Attorney, Agent, or Firm* — John D. Veldhuis-Kroeze; Westman, Champlin & Koehler, P.A.

(57) ABSTRACT

The present disclosure relates to a method and an apparatus for controlling an engine of a wheel loader, and the apparatus includes: a sensor unit, configured to sense vehicle information and working machine information; a vehicle control unit configured to select a working condition according to a priority of the vehicle information and the working machine information, select an engine mode corresponding to the selected working condition, and output an engine mode signal representing the selected engine mode; and an engine control unit configured to control the engine output according to the engine mode signal output from the vehicle control unit. Accordingly, the present disclosure provides the method and the apparatus for controlling an engine according to a working condition of a wheel loader, thereby smoothly maintaining performance of equipment without requiring a separate manipulation by a worker, and thus achieving an effect of improving fuel efficiency.

9 Claims, 3 Drawing Sheets

(51) Int. Cl.
*F02D 29/04* (2006.01)
*E02F 9/22* (2006.01)

(56) References Cited

U.S. PATENT DOCUMENTS

| | | | | |
|---|---|---|---|---|
| 2013/0006484 | A1* | 1/2013 | Avitzur | E02F 9/205 701/50 |
| 2013/0261908 | A1* | 10/2013 | Jang | E02F 9/2079 701/53 |
| 2015/0204053 | A1* | 7/2015 | Imaizumi | F02D 29/04 701/50 |

FOREIGN PATENT DOCUMENTS

| | | | |
|---|---|---|---|
| KR | 100858664 | B1 | 9/2008 |
| KR | 1020120032657 | A | 4/2012 |
| KR | 1020120072521 | A | 7/2012 |
| KR | 1020120130217 | A | 11/2012 |
| WO | 2009/017638 | A1 | 2/2009 |

OTHER PUBLICATIONS

European Search Report dated Jul. 27, 2016 for European Application No. 13865373.8, 7 pages.

* cited by examiner

FIG. 1

| CLASSIFI-CATION | ANGLE OF BOOM | POSITION OF FORWARD/REVERSE LEVER | PRESSURE OF BOOM | SPEED OF VEHICLE | WORKING CONDITION | ENGINE MODE |
|---|---|---|---|---|---|---|
| 1 | LARGE | FORWARD | HIGH | HIGH | heavy/load | power |
| 2 | LARGE | FORWARD | HIGH | LOW | digging | power (WHEN PREVIOUS MODE IS POWER) |
| | | | | | dumping | economic (WHEN PREVIOUS MODE IS NOT POWER) |
| 3 | LARGE | FORWARD | LOW | HIGH | forward/empty | economic |
| 4 | LARGE | FORWARD | LOW | LOW | forward/empty | economic |
| 5 | LARGE | REVERSE | HIGH | HIGH | load carry | normal |
| 6 | LARGE | REVERSE | HIGH | LOW | load carry | normal |
| 7 | LARGE | REVERSE | LOW | HIGH | reverse/empty | economic |
| 8 | LARGE | REVERSE | LOW | LOW | reverse/empty | economic |
| 9 | SMALL | FORWARD | HIGH | HIGH | load carry | normal |
| 10 | SMALL | FORWARD | HIGH | LOW | digging | power |
| 11 | SMALL | FORWARD | LOW | HIGH | forward/empty | economic |
| 12 | SMALL | FORWARD | LOW | LOW | forward/empty | economic |
| 13 | SMALL | REVERSE | HIGH | HIGH | load carry | normal |
| 14 | SMALL | REVERSE | HIGH | LOW | load carry | normal |
| 15 | SMALL | REVERSE | LOW | HIGH | reverse/empty | economic |
| 16 | SMALL | REVERSE | LOW | LOW | reverse/empty | economic |
| 17 | - | NEUTRAL | - | - | PREVIOUS MODE MAINTENANCE | - |

METHOD AND APPARATUS FOR CONTROLLING ENGINE OF WHEEL LOADER

CROSS-REFERENCE TO RELATED APPLICATION

This Application is a Section 371 National Stage Application of International Application No. PCT/KR2013/011150, filed Dec. 4, 2013 and published, not in English, as WO/2014098391A1 on Jun. 26, 2014.

FIELD OF THE DISCLOSURE

The present disclosure relates to a method of controlling an engine of a wheel loader, and more particularly, to a method and an apparatus for controlling an engine according to a working condition of a wheel loader.

BACKGROUND OF THE DISCLOSURE

In general, work of a wheel loader is performed by repeating a process of excavating loading materials, loading the loading materials and moving the loading materials to a destination, unloading the loading materials, and then going back to a place where the loading materials are located.

However, in the related art, a worker changes an engine mode according to each situation by individual judgment during repeating the working process, so that there is a problem in that an engine output is unnecessarily wasted, thereby degrading fuel efficiency of equipment.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Exemplary embodiments of the present disclosure are conceived in order to solve the aforementioned problem, and an object of some exemplary embodiments of the present disclosure is to provide a method and an apparatus for controlling an engine of a wheel loader, which are capable of improving fuel efficiency while smoothly maintaining performance of equipment without requiring a separate manipulation by a worker.

In accordance with a first aspect of the present disclosure in order to achieve the object, an apparatus for controlling an engine of a wheel loader according to the present disclosure includes: a sensor unit configured to sense vehicle information and working machine information; a vehicle control unit configured to select a working condition according to a priority of the vehicle information and the working machine information sensed by using the sensor unit, select an engine mode corresponding to the selected working condition, and output an engine mode signal representing the selected engine mode; and an engine control unit configured to control the engine output according to the engine mode signal output from the vehicle control unit.

In accordance with a second aspect of the present disclosure, a method of controlling an engine of a wheel loader according to the present disclosure includes: sensing vehicle information and working machine information; selecting a working condition according to the sensed vehicle information and working machine information; selecting an engine mode corresponding to the selected working condition; and controlling an engine output according to the selected engine mode, in which the selecting of the engine mode includes selecting any one engine mode among a power mode, an economic mode, and a standard mode.

As described above, according to the present disclosure, it is possible to provide the method and the apparatus for controlling an engine according to a working condition of a wheel loader, thereby smoothly maintaining performance of equipment without requiring a separate manipulation by a worker, and thus improving fuel efficiency.

BRIEF DESCRIPTION OF THE DRAWINGS

FIG. 1 is a table illustrating classification of working conditions according to a plurality of pieces of sensing information, and engine modes corresponding to respective working conditions.

DETAILED DESCRIPTION

Figure 2:
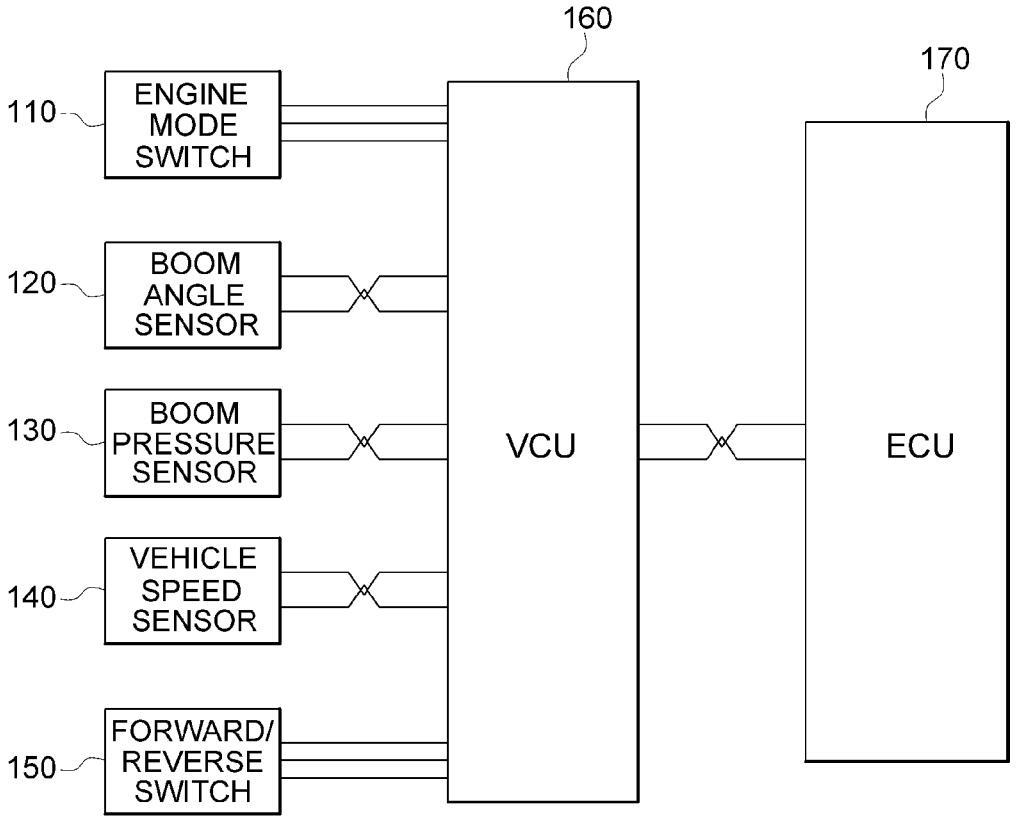
FIG. 2 is a block diagram illustrating a schematic configuration of an apparatus for controlling an engine of a wheel loader according to an exemplary embodiment of the present disclosure.

Hereinafter, an exemplary embodiment of the present disclosure will be described in detail with reference to the accompanying drawings. Further, in the following description of the present disclosure, a detailed description of publicly known configurations or functions incorporated herein will be omitted when it is determined that the detailed description may make the subject matter of the present disclosure unclear.

FIG. 1 is a table illustrating classification of working conditions according to a plurality of pieces of sensing information, and engine modes corresponding to respective working conditions.

Referring to FIG. 1, when an angle of a boom is equal to or greater than a predetermined reference value, the angle of the boom is 'large', and when an angle of a boom is smaller than the predetermined reference value, the angle of the boom is 'small'. When a pressure of the boom is equal to or greater than a predetermined reference value, the pressure of the boom is 'high', and when a pressure of the boom is smaller than the predetermined reference value, the pressure of the boom is 'low'. Further, when a speed of a vehicle is equal to or greater than a predetermined reference value, the speed of the vehicle is 'high', and when a speed of a vehicle is smaller than the predetermined reference value, the speed of the vehicle is 'low'. Here, each predetermined reference value may be differently set depending on equipment.

In the meantime, a working condition according to the present disclosure may be classified into 'heavy/load', 'digging', 'dumping', 'forward/empty', 'load carry', 'reverse/empty', 'previous mode maintenance', and the like.

'Heavy/load' represents a state where a vehicle carries a heavy load. 'Digging' represents a state where a vehicle performs digging work, that is, excavating work. 'Dumping' represents a state where a vehicle performs dumping work, that is, unloading work. 'Forward/empty' represents a state where a vehicle moves forward without loading a load. 'Load carry' represents a state where a vehicle loads a load and moves. 'Reverse/empty' represents a state where a vehicle moves reversely without loading a load.

Further, presently, an engine mode is divided into a power mode, an economic mode, and a normal mode according to a characteristic of working in an industrial vehicle mounted with a transmission, such as a wheel loader. Here, the power mode is a mode emphasizing driving force, the economic mode is a mode emphasizing a fuel efficiency aspect, and the normal mode, which is a generally used mode, is a mode in which fuel efficiency and driving force are appropriately combined.

According to a method and an apparatus for controlling an engine of a wheel loader according to the present disclosure, when the angle of the boom is 'large', a position of a forward/reverse lever is 'forward', the pressure of the boom is 'low', and the speed of the vehicle is 'high', the working condition is selected as 'forward/empty', and the economic mode corresponding to the selected working condition 'forward/empty' is selected as the engine mode, such that an engine output is controlled.

Further, when the angle of the boom is 'small', a position of the forward/reverse lever is 'reverse', the pressure of the boom is 'high', and the speed of the vehicle is 'low', the working condition is selected as 'load carry', and the normal mode corresponding to the selected working condition 'load carry' is selected as the engine mode, such that an engine output is controlled.

FIG. 2 is a block diagram illustrating a schematic configuration of an apparatus for controlling an engine of a wheel loader according to an exemplary embodiment of the present disclosure.

Referring to FIG. 2, the apparatus for controlling the engine of the wheel loader according to the present disclosure includes an engine mode switch 110, a boom angle sensor 120, a boom pressure sensor 130, a vehicle speed sensor 140, a forward and reverse switch 150, a vehicle control unit (VCU) 160, an engine control unit (ECU) 170, and the like.

The engine mode switch 110 selects any one engine mode among a power mode, an economic mode, a normal mode, and an auto mode.

The boom angle sensor 120 senses an angle of a boom.

The boom pressure sensor 130 senses a pressure of the boom.

The vehicle speed sensor 140 senses a speed of a vehicle.

The forward/reverse switch 150 senses a position of a forward/reverse lever. That is, the forward/reverse switch 150 determines whether the wheel loader is currently moving forward or in reverse.

When the engine mode switch 110 selects the auto mode as the engine mode, the VCU 160 selects a working condition according to the angle of the boom sensed by the boom angle sensor 120, the pressure of the boom sensed by the boom pressure sensor 130, the speed of the vehicle sensed by the vehicle speed sensor 140, and the position of the forward/reverse lever sensed by the forward/reverse switch 150, selects an engine mode corresponding to the selected working condition, and outputs an engine mode signal corresponding to the selected engine mode. Here, the VCU 160 selects any one engine mode among the power mode, the economic mode, and the normal mode.

Particularly, when the pressure of the boom is 'low', the VCU 160 determines that there is no load, and selects the economic mode.

Further, when the pressure of the boom is 'high', the VCU 160 determines that there is a load, and selects the normal mode.

Further, when the angle of the boom is 'small', and the speed of the vehicle is low' in the state where the pressure of the boom is 'high', the VCU 160 determines that the working condition is 'digging', and selects the power mode.

Further, when the angle of the boom is 'large' in the state where the pressure of the boom is 'high', the VCU 160 selects an engine mode according to the speed of the vehicle. Particularly, when the speed of the vehicle is 'high', the VCU 160 determines that the working condition is 'heavy/load' and selects the power mode, and when the speed of the vehicle is 'low', the VCU 160 selects the power mode or the economy mode according to a previous engine mode. For example, when the position of the forward/reverse lever is changed from reverse to forward in the state where the pressure of the boom is 'high' and the angle of the boom is 'large', the VCU 160 changes the normal mode to the economic mode.

The ECU 170 changes an RPM torque value of an engine output according to the engine mode signal output from the VCU 160 to control the engine output.

Figure 3:
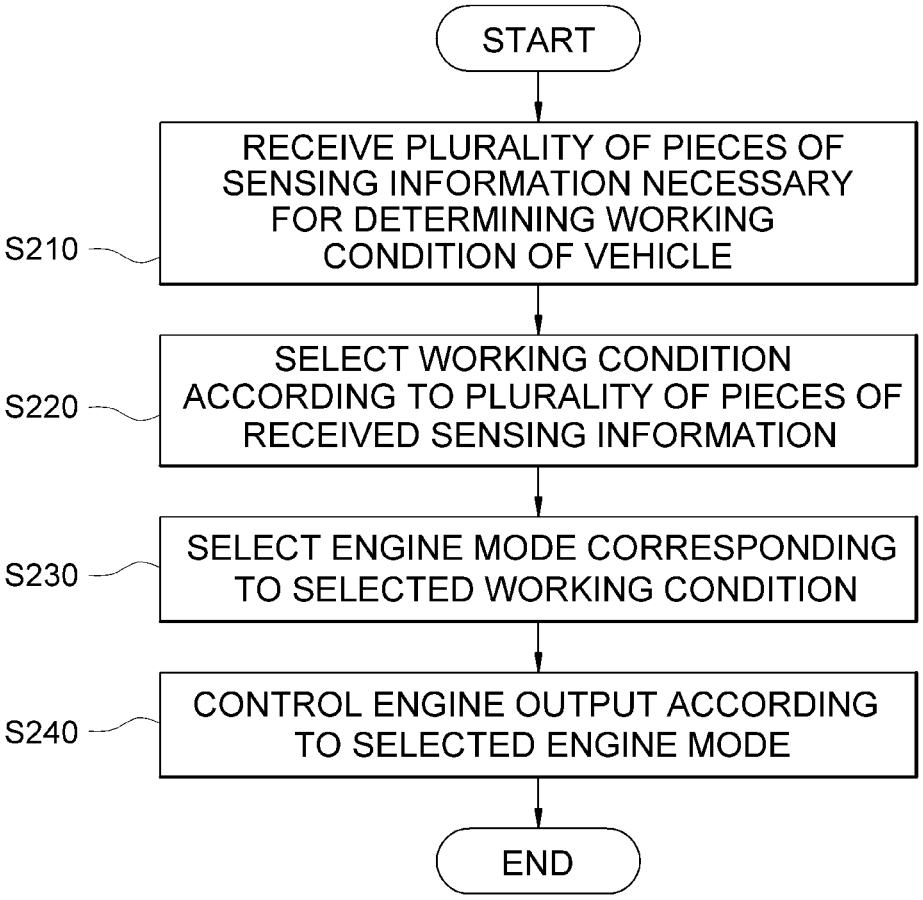
FIG. 3 is a flowchart illustrating a method of controlling an engine of a wheel loader according to an exemplary embodiment of the present disclosure.

FIG. 3 is a flowchart illustrating a method of controlling an engine of a wheel loader according to an exemplary embodiment of the present disclosure.

Referring to FIG. 3, a plurality of pieces of sensing information, that is, vehicle information and working machine information, necessary for selecting a working operation of a vehicle is received (S210). In this case, the boom angle sensor 120 senses an angle of the boom, the boom pressure sensor 130 senses a pressure of the boom, the vehicle speed sensor 140 senses a speed of the wheel loader, and the forward/reverse switch 150 senses a position of the forward/reverse lever.

A working condition is selected according to the plurality of pieces of received sensing information (S220). Particularly, the VCU 160 determines a working condition according to the angle of the boom sensed by the boom angle sensor 120, the pressure of the boom sensed by the boom pressure sensor 130, the speed of the wheel loader sensed by the vehicle speed sensor 140, and the position of the forward/reverse lever sensed by the forward/reverse switch 150.

Next, an engine mode corresponding to the selected working condition is selected (S230). Particularly, the VCU 160 selects any one engine mode among the power mode, the economic mode, and the normal mode, and outputs an engine mode signal corresponding to the selected engine mode.

Next, an engine output is controlled according to the selected engine mode (S240). Particularly, the ECU 170 changes an RPM torque value of an engine output according to the engine mode signal output from the VCU 160 to control the engine output.

The exemplary embodiments disclosed in the specification of the present disclosure will not limit the present disclosure. The scope of the present disclosure shall be construed on the basis of the following claims, and it shall be construed that all of the technical ideas included within the scope equivalent to the claims belong to the present disclosure.

The method and apparatus for controlling an engine of a wheel loader according to the present disclosure exceeds a limit of the related art in that it is possible to smoothly maintain performance of equipment without requiring a separate manipulation by a worker by controlling an engine according to a working condition of a wheel loader, thereby improving fuel efficiency of equipment, so that the present disclosure can be sufficiently used for a related technique, and an apparatus, to which the present disclosure is applied, can be marketed or available for business, and the present disclosure can be also realistically and obviously carried out, and thus the present disclosure is industrially applicable.

The invention claimed is:

1. An apparatus for controlling an engine of a wheel loader, comprising:

a sensor unit including a boom pressure sensor configured to sense a pressure of a boom, and configured to sense vehicle information and working machine information;

a vehicle control unit configured to:

select a working condition according to a priority of the vehicle information and the working machine information sensed by using the sensor unit, select an engine mode corresponding to the selected working condition, and output an engine mode signal representing the selected engine mode; and an engine control unit configured to control an engine output according to the engine mode signal output from the vehicle control unit, wherein the vehicle control unit is configured such that when the pressure of the boom sensed by the boom pressure sensor is equal to or greater than a first predetermined reference value, the vehicle control unit selects a normal mode as the engine mode, and wherein the sensor unit further includes:

a boom angle sensor configured to sense an angle of the boom; and a vehicle speed sensor configured to sense a speed of a vehicle, wherein the vehicle control unit is configured such that when the angle of the boom sensed by the boom angle sensor is smaller than a second predetermined reference value, and the speed of the vehicle sensed by the vehicle speed sensor is smaller than a third predetermined reference value, the vehicle control unit selects a power mode as the engine mode.

2. The apparatus of claim 1, wherein the vehicle control unit is configured such that when the angle of the boom sensed by the boom angle sensor is equal to or greater than the second predetermined reference value, the vehicle control unit selects the engine mode according to the speed of the vehicle sensed by the vehicle speed sensor.

3. The apparatus of claim 1, wherein the sensor unit further includes:

a forward/reverse switch configured to sense a position of a forward/reverse lever, wherein the vehicle control unit is configured such that when a position of the forward/reverse lever is changed from reverse to forward, the vehicle control unit changes the engine mode from the normal mode to an economic mode.

4. An apparatus for controlling an engine of a wheel loader, comprising:

a sensor unit including a boom pressure sensor configured to sense a pressure of a boom, and configured to sense vehicle information and working machine information;

a vehicle control unit configured to:

select a working condition according to a priority of the vehicle information and the working machine information sensed by using the sensor unit, select an engine mode corresponding to the selected working condition, and output an engine mode signal representing the selected engine mode; and an engine control unit configured to control an engine output according to the engine mode signal output from the vehicle control unit, wherein the vehicle control unit is configured such that when the pressure of the boom sensed by the boom pressure sensor is equal to or greater than a first predetermined reference value, the vehicle control unit selects a normal mode as the engine mode, and wherein the sensor unit further includes:

a boom angle sensor configured to sense an angle of the boom; and a vehicle speed sensor configured to sense a speed of a vehicle, wherein the vehicle control unit is configured such that when the angle of the boom sensed by the boom angle sensor is equal to or greater than a second predetermined reference value, the vehicle control unit selects the engine mode according to the speed of the vehicle sensed by the vehicle speed sensor.

5. The apparatus of claim 4, wherein the vehicle control unit is configured such that when the angle of the boom sensed by the boom angle sensor is smaller than a second predetermined reference value, and the speed of the vehicle sensed by the vehicle speed sensor is smaller than a third predetermined reference value, the vehicle control unit selects a power mode as the engine mode.

6. The apparatus of claim 4, wherein the sensor unit further includes:

a forward/reverse switch configured to sense a position of a forward/reverse lever, wherein the vehicle control unit is configured such that when a position of the forward/reverse lever is changed from reverse to forward, the vehicle control unit changes the engine mode from the normal mode to an economic mode.

7. An apparatus for controlling an engine of a wheel loader, comprising:

a sensor unit including a boom pressure sensor configured to sense a pressure of a boom, and configured to sense vehicle information and working machine information;

a vehicle control unit configured to:

select a working condition according to a priority of the vehicle information and the working machine information sensed by using the sensor unit, select an engine mode corresponding to the selected working condition, and output an engine mode signal representing the selected engine mode; and an engine control unit configured to control an engine output according to the engine mode signal output from the vehicle control unit, wherein the vehicle control unit is configured such that when the pressure of the boom sensed by the boom pressure sensor is equal to or greater than a first predetermined reference value, the vehicle control unit selects a normal mode as the engine mode, and wherein the sensor unit further includes:

a forward/reverse switch configured to sense a position of a forward/reverse lever, wherein the vehicle control unit is configured such that when a position of the forward/reverse lever is changed from reverse to forward, the vehicle control unit changes the engine mode from the normal mode to an economic mode.

8. The apparatus of claim 7, wherein the sensor unit further includes:

a boom angle sensor configured to sense an angle of the boom; and a vehicle speed sensor configured to sense a speed of a vehicle, wherein the vehicle control unit is configured such that when the angle of the boom sensed by the boom angle sensor is smaller than a second predetermined reference value, and the speed of the vehicle sensed by the vehicle speed sensor is smaller than a third predetermined reference value, the vehicle control unit selects a power mode as the engine mode.

9. The apparatus of claim 7, wherein the sensor unit further includes:

a boom angle sensor configured to sense an angle of the boom; and a vehicle speed sensor configured to sense a speed of a vehicle, wherein the vehicle control unit is configured such that when the angle of the boom sensed by the boom angle sensor is equal to or greater than a second predetermined reference value, the vehicle control unit selects the engine mode according to the speed of the vehicle sensed by the vehicle speed sensor.

* * * * *